US006108997A

United States Patent [19]

Blais et al.

[11] Patent Number: 6,108,997

[45] Date of Patent: Aug. 29, 2000

[54] VINYL WINDOW SCREEN FRAME

[75] Inventors: Jacques Blais, Brighton; Dominic Vessio, Pickering, both of Canada

[73] Assignee: Slim-Line Vinyl Windows Mfg., Inc., Pickering, Canada

[21] Appl. No.: 09/033,230

[22] Filed: Mar. 2, 1998

[30] Foreign Application Priority Data

Feb. 4, 1998 [CA] Canada ..... 2228612

[51] Int. Cl.[7] ..... E06B 1/14

[52] U.S. Cl. ..... 52/656.7; 52/656.6; 52/656.2; 52/656.1; 52/204.62; 52/204.69; 49/DIG. 2; 160/371

[58] Field of Search ..... 49/505, DIG. 2; 160/369, 371, 372, 381, 105; 52/656.7, 656.6, 656.2, 656.1, 204.62, 204.69, 204.7

[56] References Cited

U.S. PATENT DOCUMENTS

| | | | |
|---|---|---|---|
| 1,760,612 | 5/1930 | Trott | 160/369 |
| 2,329,485 | 9/1943 | Renton | 160/105 |
| 2,598,770 | 6/1952 | Drozt | 160/105 |
| 2,624,428 | 1/1953 | Mason et al. | 160/369 |
| 2,728,117 | 12/1955 | Zappone et al. | 20/52.2 |
| 2,760,607 | 8/1956 | Bongiovanni | 189/75 |
| 2,780,327 | 2/1957 | Carlson | 189/75 |
| 2,997,103 | 8/1961 | Buchanan | 160/105 |
| 2,999,279 | 9/1961 | Lauer | 52/204.62 |
| 3,606,419 | 9/1971 | Virkler et al. | 160/381 X |
| 5,069,947 | 12/1991 | Hopperdietzel | 49/DIG. 2 X |

*Primary Examiner*—Carl D. Friedman
*Assistant Examiner*—Phi Dieu Tran A
*Attorney, Agent, or Firm*—Arter & Hadden LLP

[57] ABSTRACT

A vinyl window or door screen frame which does not require clips or hooks for installation. The frame contains corner keys formed at angles greater than 91° which provide a slight bow along each side of the screen frame. This feature allows the screen frame to fit snugly into the window frame. The use of vinyl makes the screen frame flexibly rigid and thus allows for the bow in the frame. The frame stays in place due to the compression force between the window frame and the bowed edges of the screen frame.

20 Claims, 9 Drawing Sheets

VINYL WINDOW SCREEN FRAME

FIELD OF THE INVENTION

This invention relates in general to screen frames and more specifically to a vinyl screen frame for fitting into a door or window which may be implemented without the need for hooks or snaps. The screen frame is slightly flexible, of a colour that matches the window frame and fits snugly inside the window by compression force for easy installation or removal.

BACKGROUND OF THE INVENTION

Presently, with door or window installations, it is desirable to install a screen within a door or window so that, when a window or inner door is opened, the screen is in place to prevent insects and the like from entering the premises through the open orifice, while allowing the free flow of air for ventilation. However, during winter months, it is often desirable to remove the screen and replace it with a window for extra protection and insulation during the cold and stormy season. In the prior art, the installation or removal process involves manipulating cumbersome hooks or snaps because the screen support or frame can not be simply slotted and fixed into place. Extra manual effort is involved in closing or opening each hook in order to fasten or unfasten the screen support or frame each time the screen is being installed or removed.

In addition, with window and door frames being composed of various materials, such as metal, wood and vinyl, it is common for existing doors and windows to be of a different colour than the screen support or frame. This causes the screen support or frame to be visually distinguishable from the door or window frame and does not provide for an aesthetically pleasing product. Moreover, many current screen frames are made of a metal such as aluminum which is rigid and does not provide a high degree of resilient flexibility.

In one common design of screen support or frames, there are four straight segments, i.e. the top, the bottom, the left and the right, connected at their respective ends to form the corners of the screen frame. The ends of each segment are cut to forty-five degree (45°) angles and are either connected or welded together to form ninety degree (90°) corners. A common method of connecting segments involves the use of right angle shaped connectors known as corner keys. Each corner key basically consists of two legs formed at a 90° angle to form a corner. Each leg of the corner key fits into, or on the surface of, the respective ends of two separate frame segments to produce a corner. In this manner, four screen frame segments are connected together at their respective ends to form a screen frame.

There is a need in the market for a screen which is easy and inexpensive to manufacture, easy to remove and install, and aesthetically pleasing to the eye that matches the colour of the door or window.

SUMMARY OF THE INVENTION

According to one aspect of the invention there is provided a removable screen frame for fitting into a door or window frame comprising:

a first and second pair of slightly flexible, approximately parallel segments, where each segment of each pair is of the same length;

the segments being arranged in an approximately rectangular shape; and each of the segments having opposed ends with each end of the segments of the first pair being connected to respective ends of respective segments of the second pair at an angle greater than 91°.

According to a second aspect of the present invention there is provided a screen support and framing combination comprising:

an outer frame containing an opening of generally rectangular shape; and a screen frame of approximately rectangular shape slightly smaller than the outer frame which can be removably fitted into the outer frame with each corner of the screen frame formed at an angle greater than 91°.

BRIEF DESCRIPTION OF THE DRAWINGS

An embodiment of the invention is described below with reference to the accompanying drawings, in which.

DETAILED DESCRIPTION OF THE PREFERRED EMBODIMENT

Figure 1:
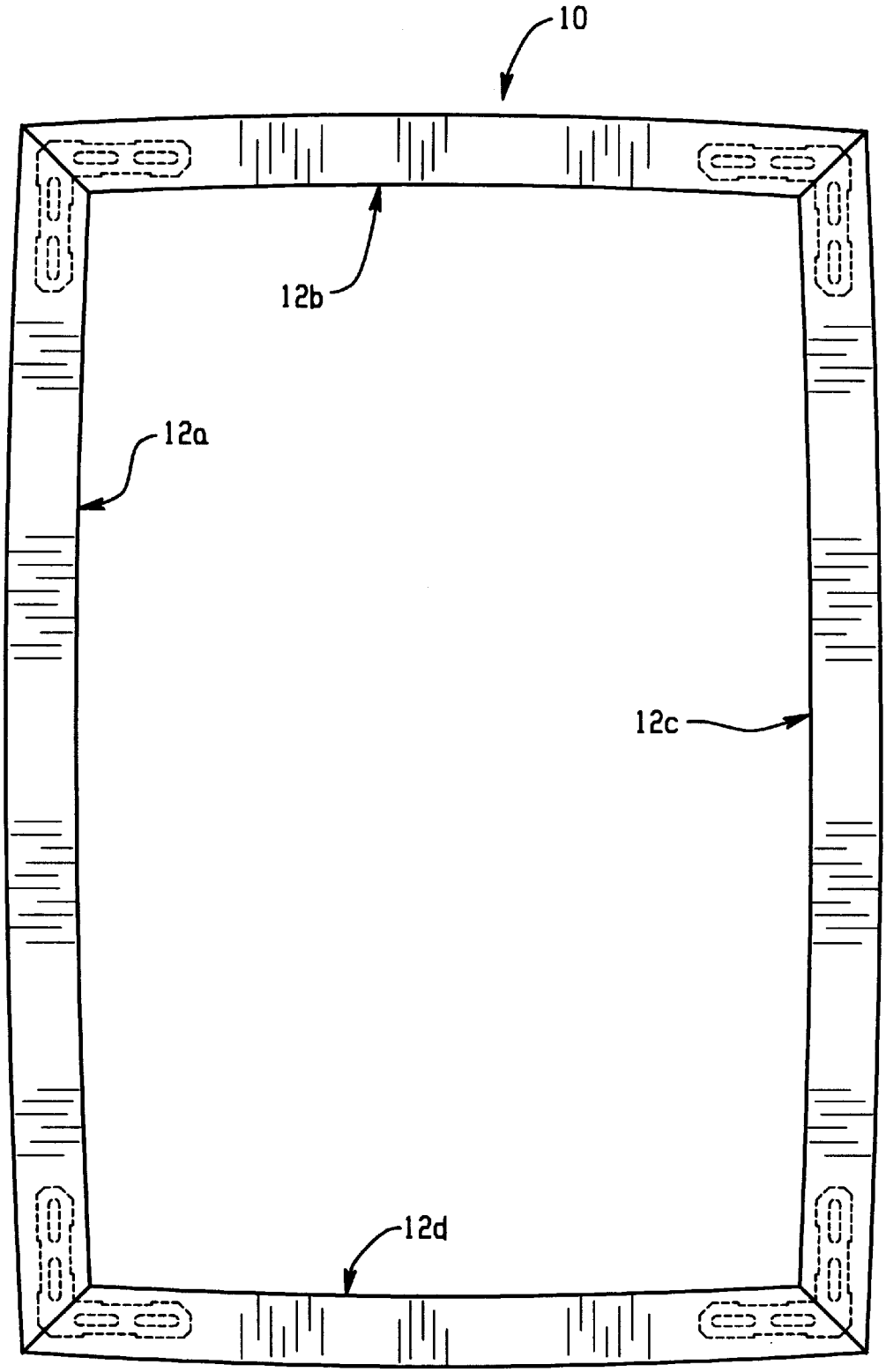
FIG. 1 is a schematic representation of a screen frame of the present invention.

Turning to FIG. 1, the screen support or frame 10 of the present invention is shown. The support screen frame 10 consists of 4 segments, 12*a*, 12*b*, 12*c*, and 12*d*, joined at the corners to form a general rectangular shape. In the preferred embodiment, the segments 12*a*, 12*b*, 12*c*, and 12*d* are joined by corner key 14 fitted into the ends of the segments 12*a*–12*d*. Other embodiments are possible where the segments are joined by welding, glueing or by separate corner pieces attached to the surface of the segments in a manner such as is well known in the art. In the preferred embodiment, the segments 12*a*–12*d* are made from a slightly flexible material such as rigid PVC, although other material could be used. The slightly flexible segments 12*a*–12*d* are joined at the ends at an angle greater than 90° such that the screen frame assumes an outwardly bowed shape from the centre of the screen frame opening. During the installation of the screen material forming the screen, preferably a metal or plastic mesh, the screen material is installed while the screen support or frame 10 is compressed inward. When the compression is released after installation of the screen material, the bow of the supporting screen frame 10 results in a screen under tension which removes the tendency of the screen material to wrinkle or sag.

The segments 12*a*–12*d* of screen frame 10 are of a slightly smaller size than the sides of the window or door frame opening. Even after installation, the corners of the screen frame 10 do not touch the inside corners of the window or door frame. During installation into a window or door frame, the screen frame 10 is manually compressed inward toward the centre of the frame and inserted into the rectangular door or window opening. The compression reduces the outside shape of the screen frame 10 allowing it to be inserted into the opening. After insertion, when the pressure on the screen frame 10 is released, the resultant expansion force pushes the sides of the screen frame tightly against the inside edge of the door or window frame, holding it in place.

The expansion force holding the screen frame 10 into place eliminates the need for spring pins, holding clips, springs or any other hardware to fasten the screen. The screen frame 10 is easy and inexpensive to manufacture, and can be installed and removed manually quickly and easily, without the need of tools or other parts. In the preferred embodiment, the screen frame 10, made of rigid PVC, can be manufactured to exactly match the colour of a vinyl window or vinyl door frame, resulting in a unified look and an esthetically pleasing product.

Figures 2A, 2B, 3A:
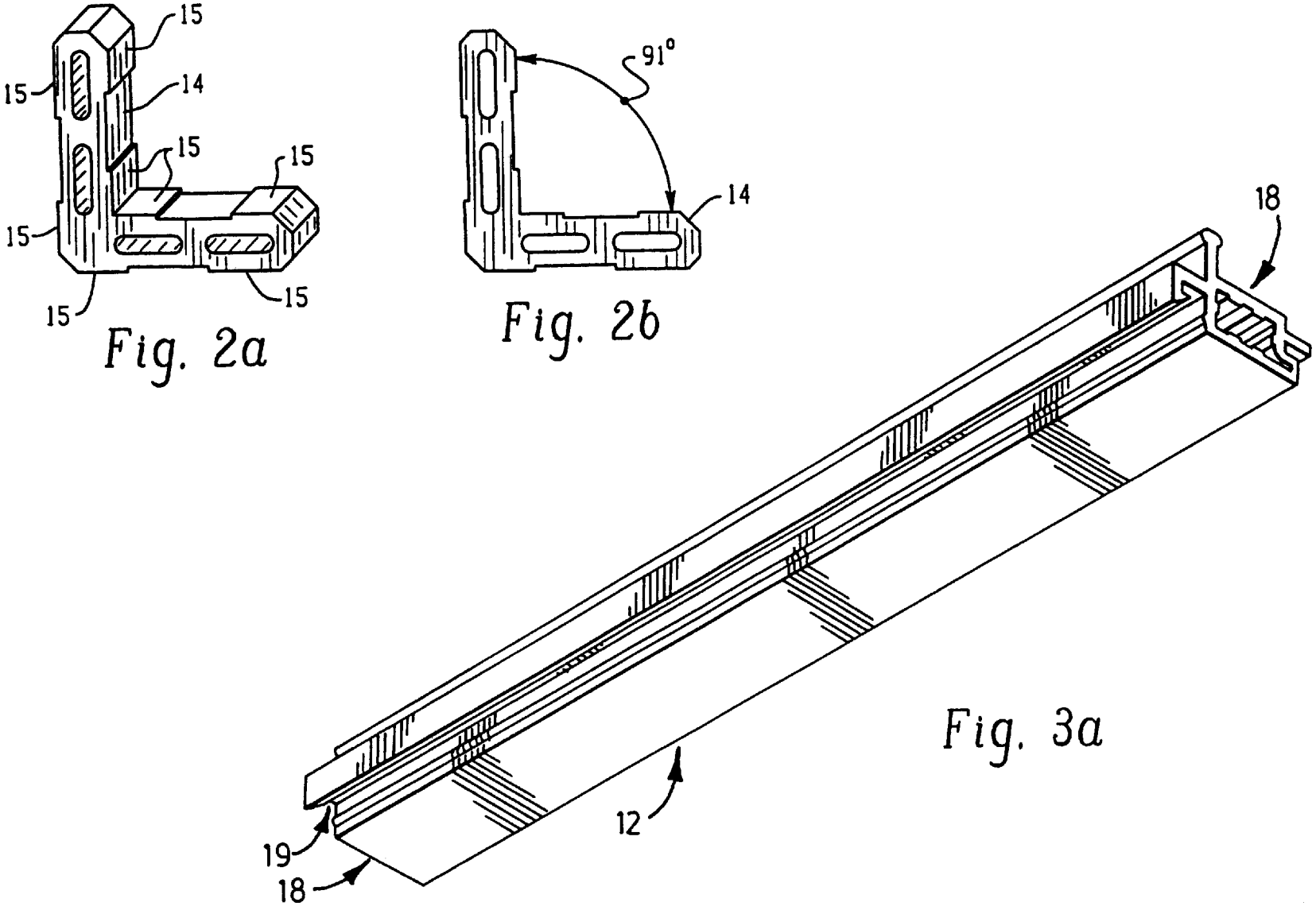
FIGS. 2*a* and 2*b* are schematic representation's illustrating a top corner view and side view respectively of a corner key used in the screen frame.
FIGS. 3*a* and 3*b* are schematic representations of alternate embodiments of one segment of the screen frame.

Turning to FIG. 2*a*, the corner key 14 is shown in greater detail. In the preferred embodiment, the corner key 14 is used to join the ends of segments 12*a*–12*d*. In alternate embodiments, any means to produce the corner described below that generates the proper bow in the side of the frame may be used. Corner key 14 has raised portions 15 which facilitate a tight friction fit into the ends of the corresponding screen frame segments. In the preferred embodiment, corner key 14 is made of rigid PVC, and is friction fitted into the respective ends of segments 12*a*–12*d*. In alternative embodiments, corner key 14 could be made of materials such as wood, metal or any other suitable material.

In FIG. 2*b*, the angular bend of corner key 14 is shown in greater detail. The corner key is bent at an angle greater than 91°, typically in the range of 91° to 96° and in the preferred embodiment at an angle of about 95° for standard window screen frames. Where corner keys are not used, the window screen segments may be formed or joined by welding, gluing or other fittings at an angle greater than 91°, typically in the range of 91°–96° and preferably at an angle of 95°.

Figure 3B:
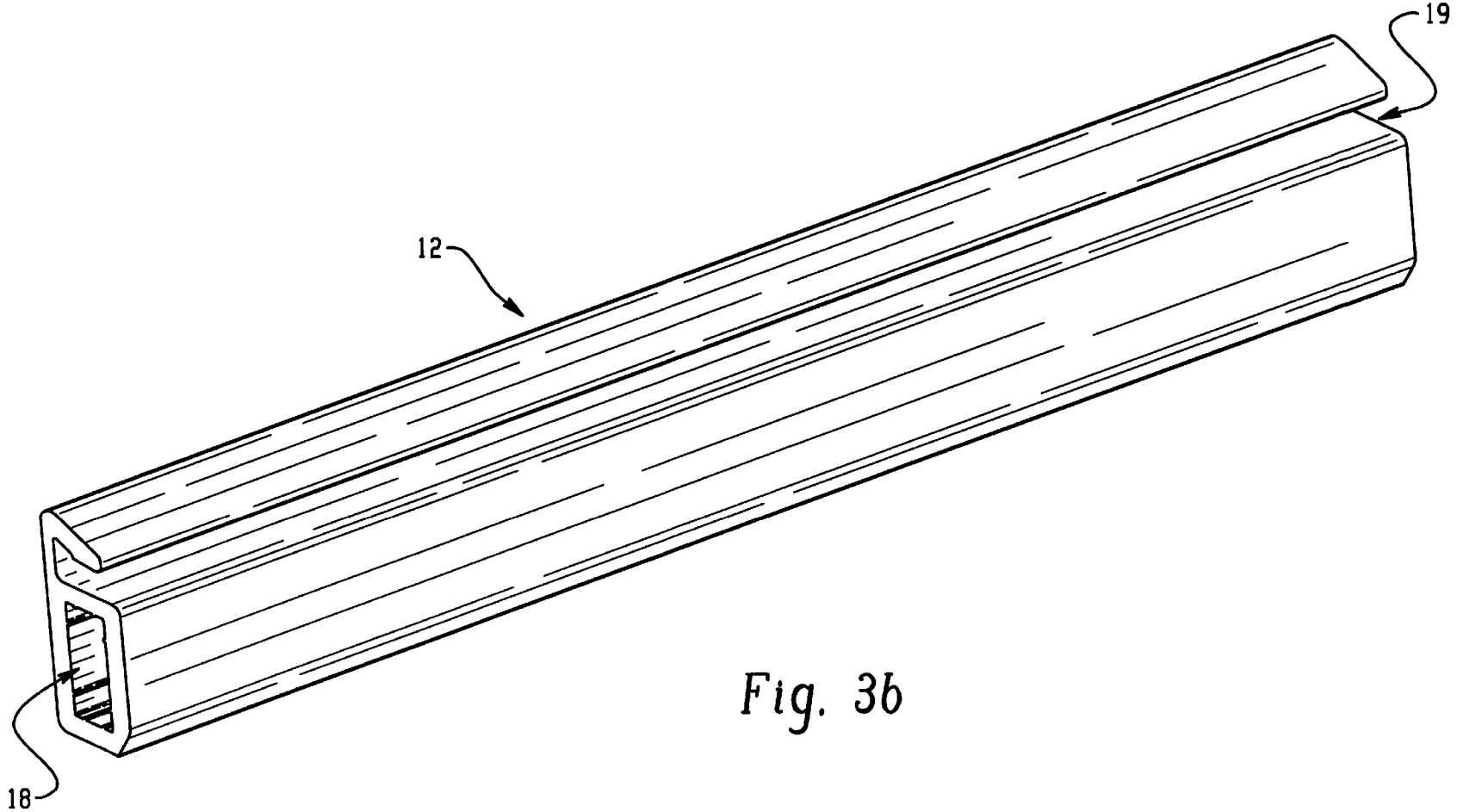

There is shown in FIGS. 3*a* and 3*b*, an example of window screen segment 12 in greater detail. FIG. 3*a* is an example of a typical segment 12 for a casement window whereas FIG. 3b depicts a typical segment 12 for use in a single hung, double hung or other standard window configurations. For the preferred embodiment, each segment 12 is made from extruded rigid PVC and each end of segment 12 has within it a slot 18 for receiving a corner key 14. In an alternative embodiment, any suitable, flexibly rigid material may be used for the screen frame segment 12. In addition, segment 12 has a groove 19 for receiving the screen mesh and screen mesh rope which fits in by compression force.

Figure 4A:
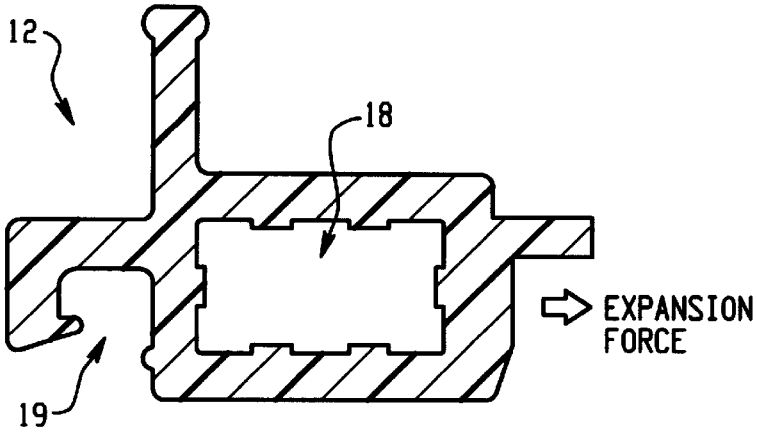
FIGS. 4*a* and 4*b* are schematic representations illustrating a cross sectional view of a typical segment.
Figure 4B:
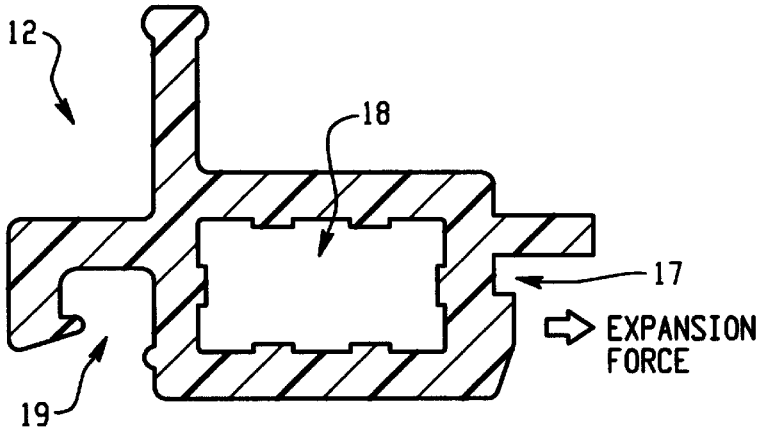

In FIGS. 4*a* and 4*b*, two different embodiments of a cross section of window screen segment 12 is shown in greater detail. As illustrated in FIG. 4*a*, each segment is held in place by an expansion force exerted by each segment of the somewhat elliptically shaped screen frame which contacts the inside of the window or door frame. In the preferred embodiment of FIG. 4*b*, a channel 17 which corresponds with a ridge in the door or window frame is placed within the segment 12 to assist in holding the screen frame in place.

Figure 4C:
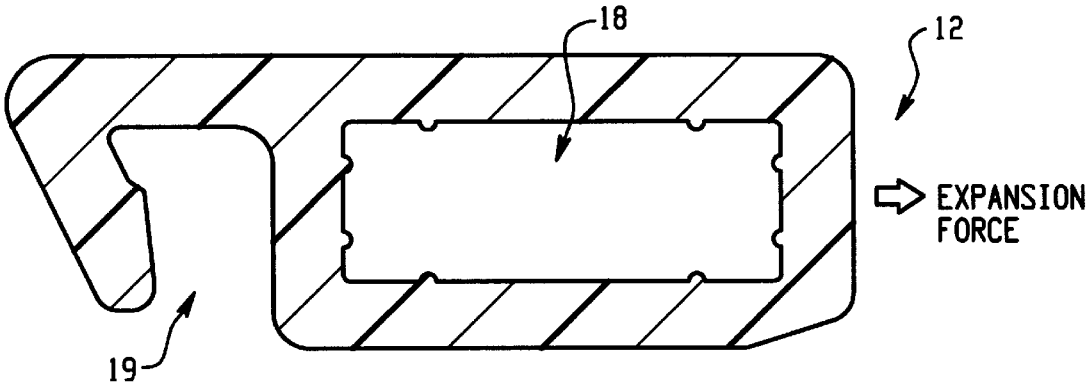

Turning to FIG. 4*c*, an alternate embodiment of window screen segment 12 is shown for general window applications such as single hung and double hung windows. Window segment 12 of FIG. 4*c* operates in the same manner as that described in FIG. 4*a* above. The segment 12 is flexibly rigid material that can be compressed for insertion of the outside edge 15 into a corresponding channel of the window or door frame.

Figure 5B:
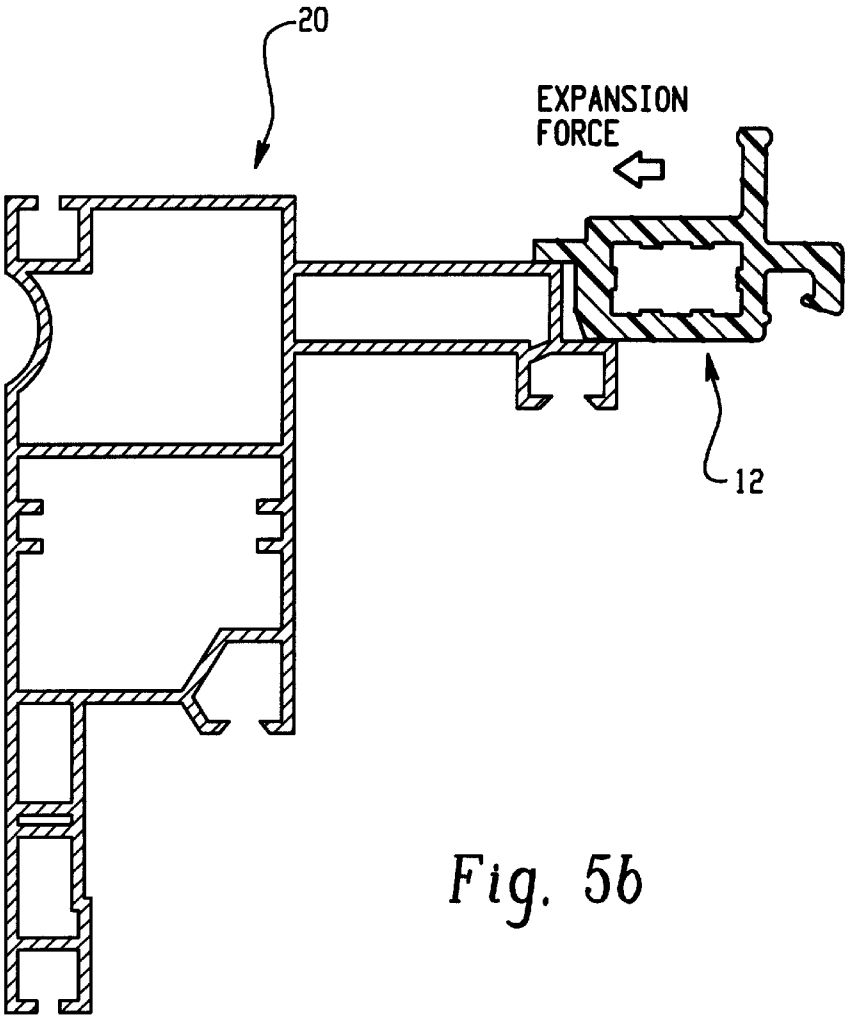
FIGS. 5*a* and 5*b* are schematic representations one embodiment of a segment fitted into a window or door frame.
Figure 5A:
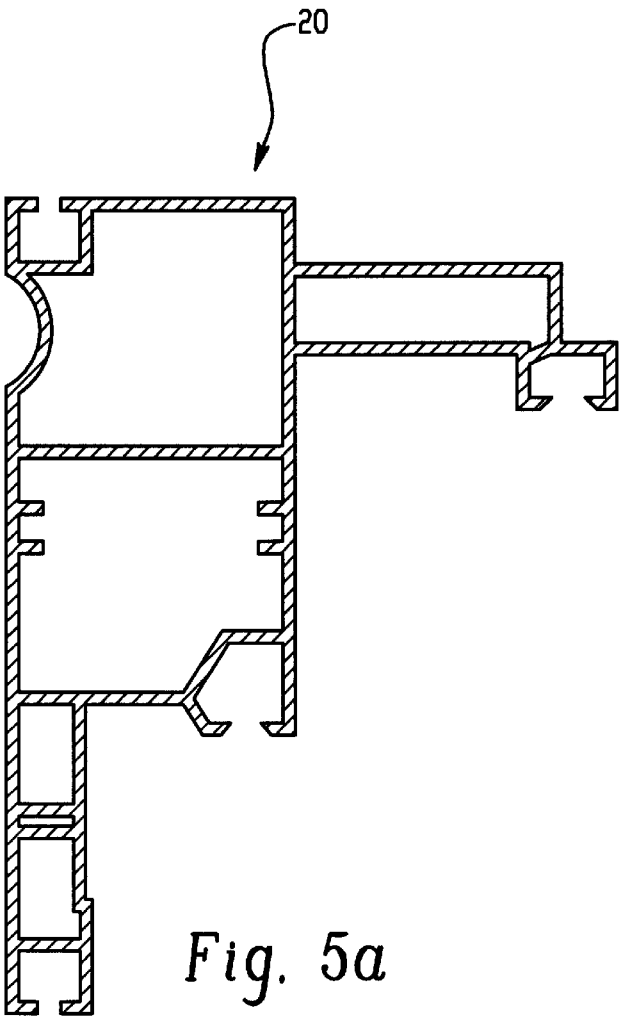

Turning to FIG. 5*a*, a side profile view of a window frame 20 for receiving the screen frame of the present invention is shown. FIG. 5*b* illustrates a typical screen frame segment 12 of the present invention inserted into the opening of window frame 20. The screen frame is held in place within the window frame 20 by the expansion force exerted by segment 12.

Figure 6B:
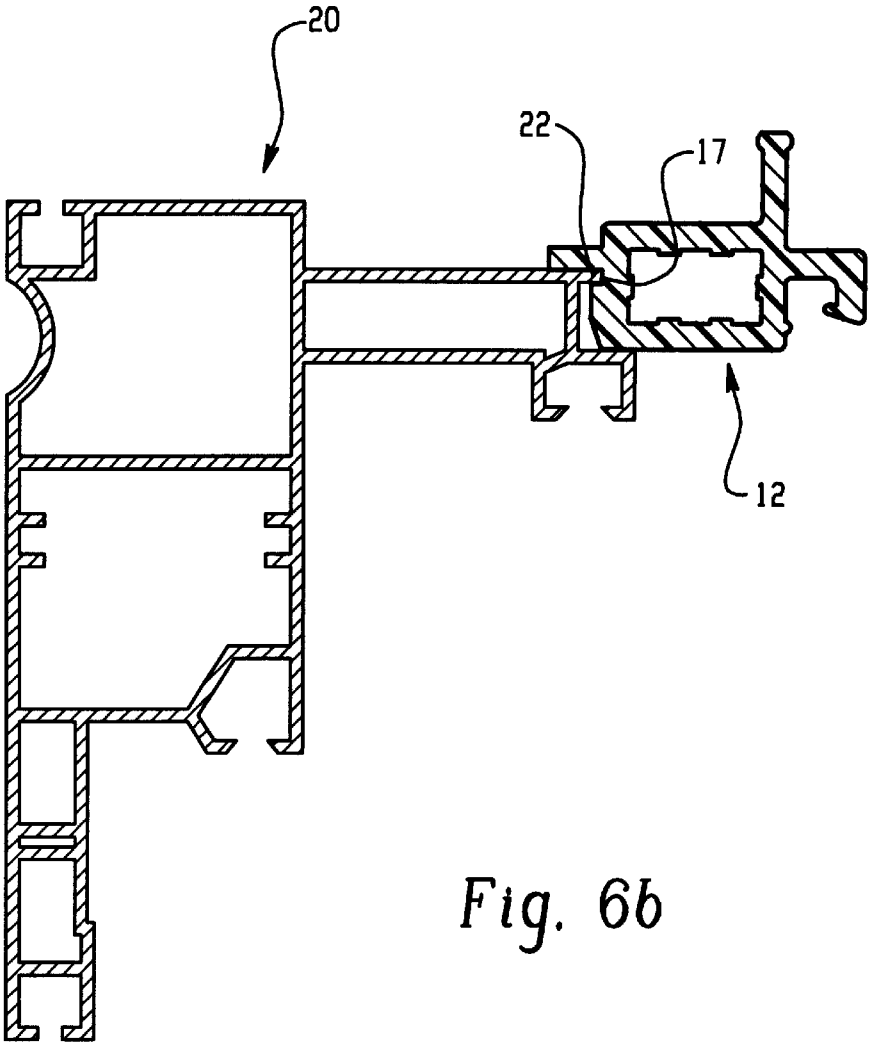
FIGS. 6*a* and 6*b* are schematic representations illustrating an exemplary embodiment of a segment fitted into a window or door frame.
Figure 6A:
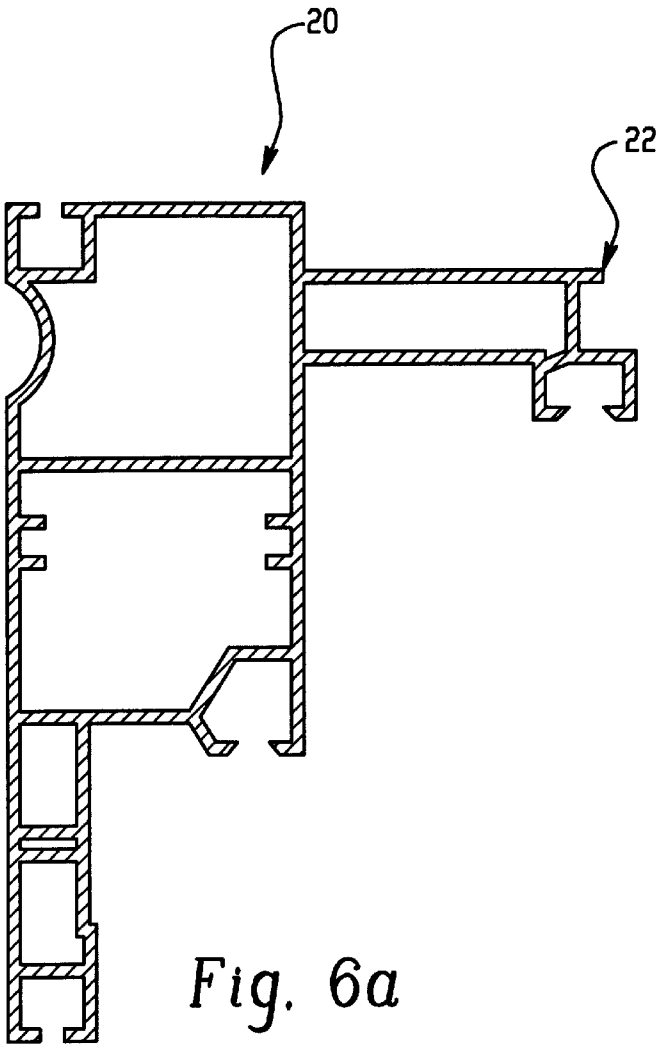

FIGS. 6*a* and 6*b* show a preferred embodiment of a window frame 20 with protrusion 22. In FIG. 6*a*, the protrusion 22 on window frame 20 assists in retaining the window screen frame within the window frame 20. During installation, segment 12 is compressed and fitted into window frame 20. When the compression force is released, the expansion force pushes segment 12 against window frame 20. As illustrated in FIG. 6*b*, protrusion 22 fits into channel 17 which assists in locking the screen frame in place. The removal procedure for the screen frame is merely the reversal of the installation procedure.

Figure 7:
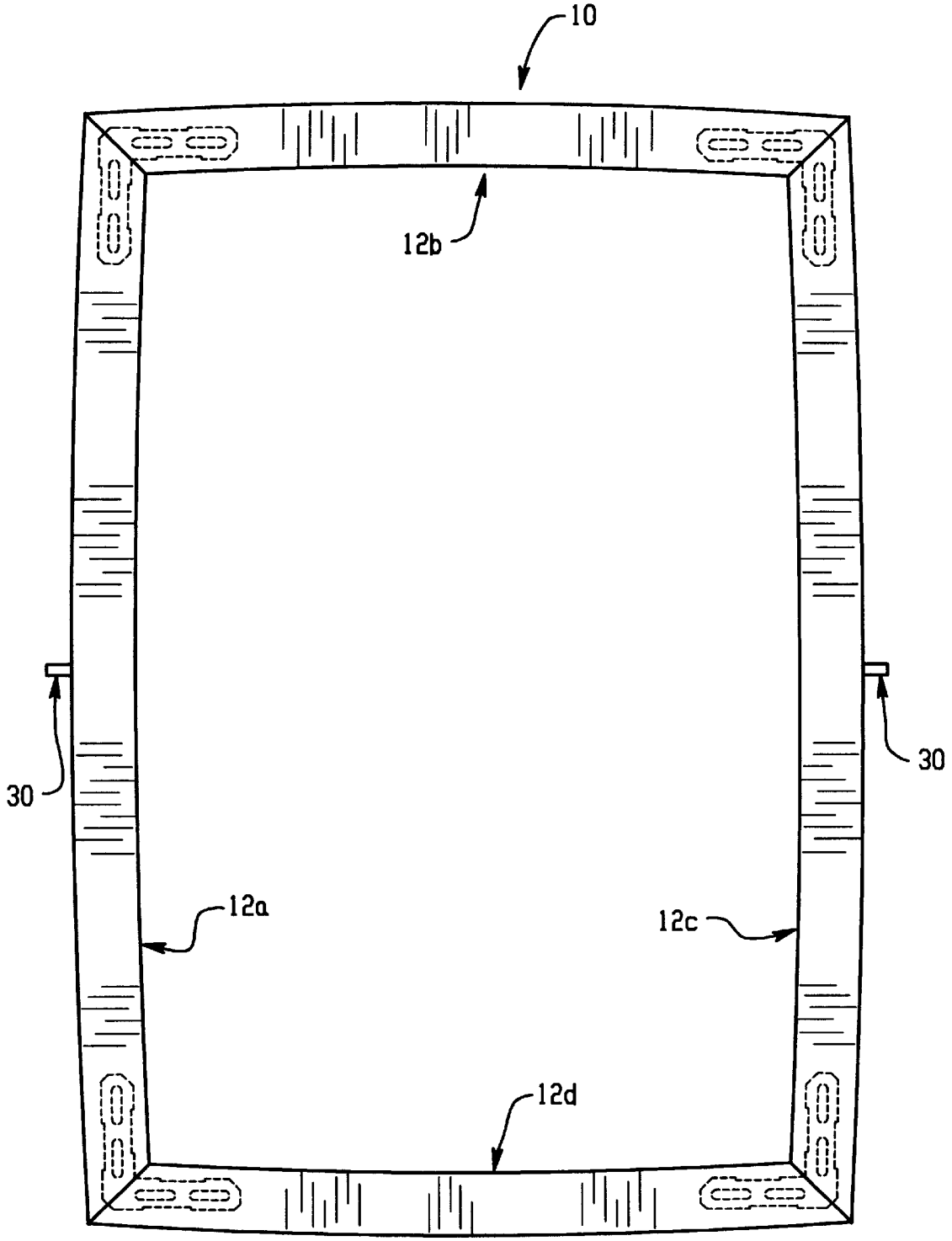
FIG. 7 is a schematic representation of an alternate embodiment of the present invention, including supporting pegs for additional support in holding the screen frame in place.

In FIG. 7, an alternate embodiment of the screen frame of the present invention is shown with pegs for additional support. As shown in FIG. 7, screen frame 10 has one or more pegs 30 protruding outwardly as illustrated on segments 12*a* and 12*c* respectively. Pegs 30 may be employed on any segment and are useful for retaining screen frame 10 within a window or door frame where the screen frame is employed in large window or door frames or high wind situations. Pegs 30 may be of any suitable material such as rigid PVC and may be inserted, moulded or glued into segment 12.

Figure 8:
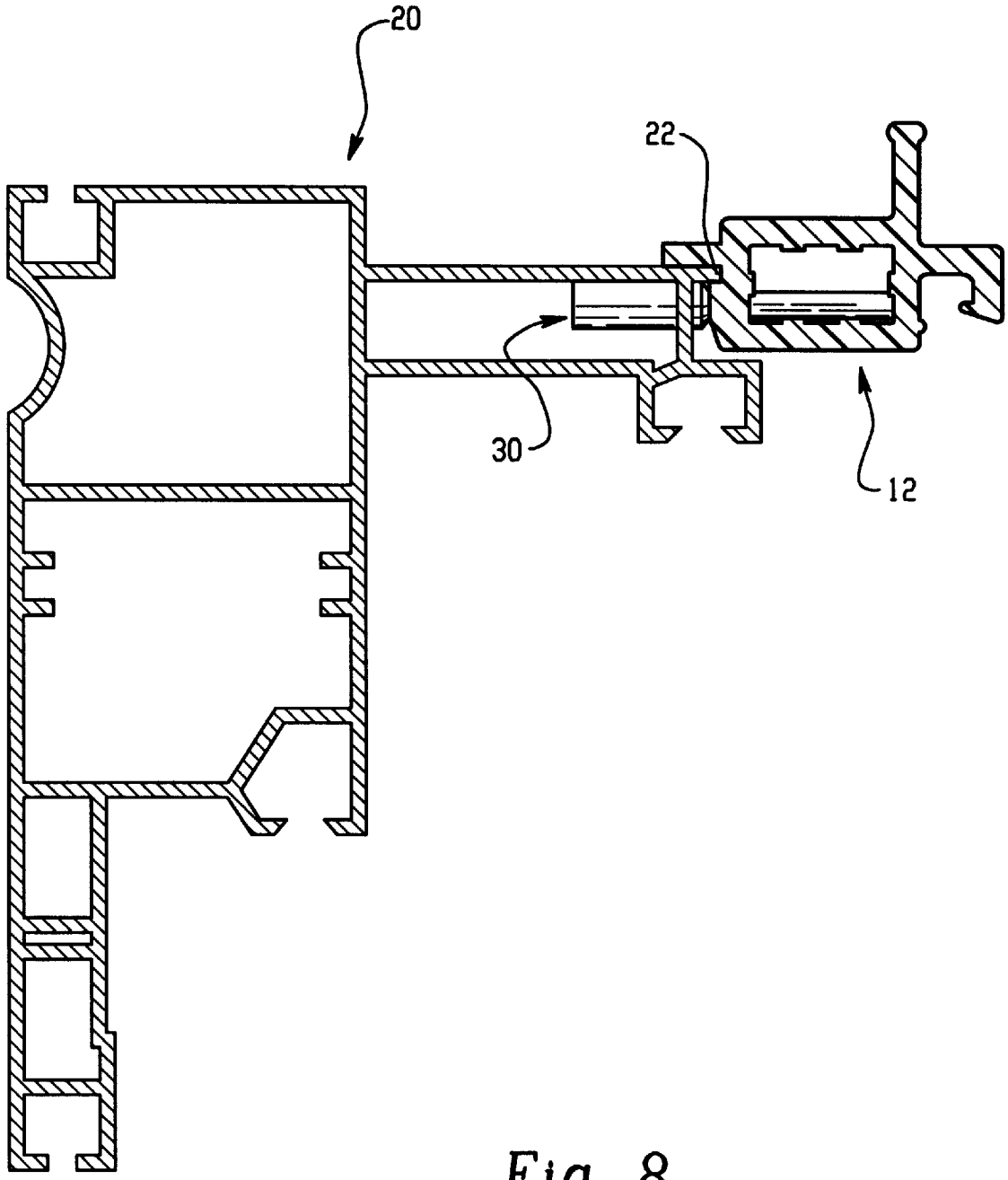
FIG. 8 is a schematic representation of an alternate embodiment of a segment of the screen frame of FIG. 7 fitting into a window or door frame.

Turning to FIG. 8, segment 12 with supporting peg 30 is shown inserted into a corresponding hole in window or door frame 20. The slightly flexible nature of segment 12 allows segment 12 to be sufficiently bent inward with manual compression force during installation and removal of the screen frame to allow peg 30 to clear protrusion 22 of the window or door frame.

When the compression force is released the expansion force on segment 12 forces peg 30 into a corresponding hole in window or door frame 20.

In alternate embodiments, not shown, a ridge or protrusion may be created on segment 12 and a corresponding channel created in window frame 20 to lock the screen frame in place.

Figure 9:
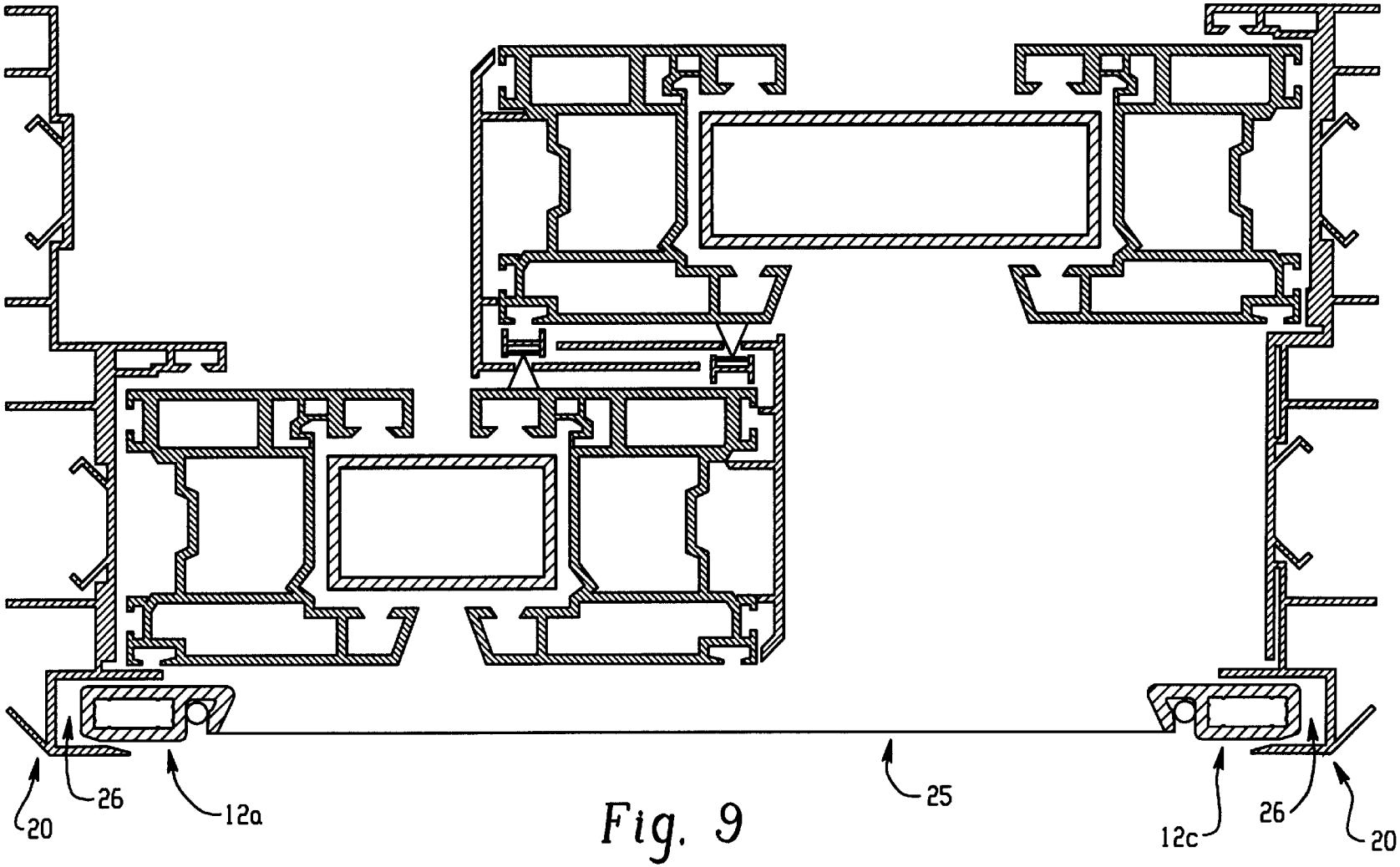
FIG. 9 is a schematic representation of a further alternate embodiment cross sectional view of a screen frame within a window or door frame.

There is shown in FIG. 9, an alternate embodiment cross section of the screen frame of the present invention. Screen frame segments 12*a* and 12*c* are of the same cross section as shown in FIG. 4*c*. Screen 25 is shown stretched between screen frame segments 12*a* and 12*c*. Screen frame segments 12*a* and 12*c* are shown engaged in channels 26 of window or door frame 20, having been inserted by compression of the screen frame segments. It will be appreciated that, although a particular embodiment of the invention has been described and illustrated in detail, various changes and modifications may be made without departing from the sphere and scope of the invention as described herein.

What is claimed is:

1. A removable screen frame for fitting into a door or window frame comprising:

a first and second pair of slightly flexible, approximately parallel segments, where each said segment of each said pair is of same length;

said segments being arranged in an approximately rectangular shape; and each of said segments having opposed ends with each said end of said segments of said first pair being connected to a respective end of a respective segment of said second pair at an angle greater than 91° forming an outwardly bowed shape under an expansion force for retaining said screen frame within said door or window frame, a screen retained by the segments;

said angle of greater than 91° being retained when screen material is stretched between said segments.

2. The screen frame of claim 1, wherein said ends of said segments are connected at an angle of between 91° and 96°, said angle of between 91° and 96° being retained when screen material is stretched between said segments.

3. The screen frame of claim 1, wherein said ends of said segments are connected at an angle of about 95°, said angle of about 95° being retained when screen material is stretched between said segments.

4. The screen frame of claim 1, 2, or 3 wherein said ends of said segments are connected and retained by corner keys.

5. The screen frame of claim 4, wherein said segments are made of rigid PVC.

6. The screen frame of claim 5, wherein screen material is stretched between said segments.

7. The screen frame of claim 4, wherein one or more said segments contain one or more pegs directed outward from the centre of said screen frame.

8. A screen support and framing combination comprising:

an outer frame containing an opening of generally rectangular shape; and a screen support and framing combination comprising:

a screen frame of approximately rectangular shape slightly smaller than said outer frame which can be removably fitted into said outer frame with each corner of said screen frame formed at an angle greater than 91° forming an approximately rectangular outwardly bowed shape under an expansion force wherein said screen frame is retained within said outer frame by said expansion force exerted by the outer edge of said screen frame against the inner edge of said outer frame;

a screen retained by the screen frame;

said angle of greater than 91° being retained when screen material is stretched between said screen frame.

9. The screen support and framing combination of claim 8, wherein a protrusion into said opening on said inner edge of said outer frame engages a channel on said outer edge of said screen frame.

10. The screen support and framing combination of claim 6, wherein said screen frame engages a channel on said inner edge of said outer frame.

11. The screen support and framing combination of claim 9, or claim 10, wherein each said corner forms an angle of between 91° and 96°, said angle of between 91° and 96°, said angle of between 91° and 96° being retained when screen material is stretched between said screen frame.

12. The screen support and framing combination of claim 11, wherein each said corner is held together by corner keys.

13. The screen support and framing combination of claim 12, wherein screen material is stretched and retained within said screen frame.

14. The screen support and framing combination of claim 13, wherein one or more sides of said screen frame contain one or more pegs directed outward from the centre of said screen frame engaging corresponding holes in said outer frame.

15. The screen support and framing combination of claim 13, wherein said screen frame is of rigid PVC.

16. The screen support and framing combination of claim 9 or claim 10, wherein said corner forms an angle of about 95°, said angle of about 95° being retained when screen material is stretched between said screen frame.

17. The screen support and framing combination of claim 16, wherein each said corner is held together by corner keys.

18. The screen support and framing combination of claim 17, wherein one or more sides of said screen frame contain one or more pegs directed outward from the centre of said screen frame engaging corresponding holes in said outer frame.

19. The screen support and framing combination of claim 18, wherein screen material is stretched and retained within said screen frame.

20. The screen support and framing combination of claim 18, wherein said screen frame is of rigid PVC.

* * * * *